United States Patent [19]

Heath

[11] Patent Number: 4,804,101

[45] Date of Patent: Feb. 14, 1989

[54] CONTAINER ASSEMBLY INCLUDING LOWER COMPARTMENT COMPRISING CHORDAL PARTITIONS

[75] Inventor: Bruce A. Heath, Hennessey, Okla.

[73] Assignee: IAT Corporation, Hennessey, Okla.

[21] Appl. No.: 162,960

[22] Filed: Mar. 2, 1988

[51] Int. Cl.[4] ..... B65D 69/00

[52] U.S. Cl. ..... 220/20; 206/37; 206/38; 206/236; 206/380; 220/23; 220/23.83; 312/73

[58] Field of Search ..... 206/37, 38, 236, 256, 206/216, 537, 538, 380, 349; 220/20, 23, 23.83, 68; 312/72, 73; 215/6; 221/186; 222/553

[56] References Cited

U.S. PATENT DOCUMENTS

| | | | |
|---|---|---|---|
| 57,139 | 8/1866 | Huchans | 206/38 R |
| 662,353 | 11/1900 | Clement | 222/553 |
| 936,327 | 10/1909 | Kerrick | 206/37 R |
| 1,333,695 | 3/1920 | Anshelm | 312/73 X |
| 1,935,840 | 11/1933 | Fitzgerald . | |
| 2,077,219 | 4/1937 | Conner | 215/6 |
| 2,092,219 | 9/1937 | Knox | 206/37 |
| 2,573,311 | 10/1951 | Cupler II . | |
| 2,765,576 | 10/1956 | Kurek | 220/20 X |
| 2,782,917 | 2/1957 | Kruft | 312/73 |
| 2,884,122 | 4/1959 | Severson | 206/37 |
| 3,024,898 | 3/1962 | Schumacher . | |
| 3,225,915 | 12/1965 | Wise | 220/23 X |
| 3,356,208 | 12/1967 | Kondo | 206/38 |
| 3,472,361 | 10/1969 | Farsaie | 206/38 |
| 4,583,667 | 4/1986 | Fishmen et al. | 222/553 X |

FOREIGN PATENT DOCUMENTS

| | | | |
|---|---|---|---|
| 842781 | 3/1939 | France | 206/38 R |
| 136438 | 1/1930 | Switzerland | 206/38 R |
| 463736 | 4/1937 | United Kingdom | 206/37 R |

*Primary Examiner*—Stephen Marcus
*Assistant Examiner*—Bryon Gehman
*Attorney, Agent, or Firm*—Laney, Dougherty, Hessin & Beavers

[57] ABSTRACT

A container assembly for containing a commodity in a cylindrical primary container, and further including a cylindrical base and dispenser subassembly for receiving the cylindrical container, and for dispensing elongated, thin articles. The base and dispenser subassembly includes an upwardly extending peripheral flange, a downwardly extending peripheral flange and a transverse partition therebetween carrying the flanges. Parallel chordal partitions extend across, and substantially normal to, the transverse partition, and define a multiple article storage compartment. A dispenser closure cap includes an end plate which extends across the top of the article storage compartment. The end plate carries an annular outer flange which rotatably engages the downwardly extending peripheral flange. A mirror is affixed to the exterior of the end plate. In another form, the primary container may simply be formed as an integral part of the base and dispenser subassembly.

13 Claims, 1 Drawing Sheet

CONTAINER ASSEMBLY INCLUDING LOWER COMPARTMENT COMPRISING CHORDAL PARTITIONS

BACKGROUND OF THE INVENTION

1. Field of the Invention

This invention relates to containers from which multiple articles can be dispensed, and which can be easily refilled for repeated use.

2. Brief Description of the Prior Art

In recent years, the use of smokeless tobacco has increased and has become more fashionable, particularly among the younger set in some locations. The use of smokeless tobacco or snuff for chewing or dipping causes some problems cosmetically, in that particles of tobacco may lodge between the teeth and, of course, the teeth become stained from repeated tobacco usage.

In view of such cosmetic problems, it is desirable to provide a container assembly which contains not only the smokeless tobacco to be used, but retains in close proximity to the tobacco, one or more toothpicks or similar devices which can be used for cleaning the teeth. Preferably, too, a mirror is supported in a protected position in close proximity to the toothpicks and smokeless tobacco, so that the user of the tobacco can thoroughly clean his teeth when such is needed after use of the tobacco.

No container assembly of the prior art which is known to me affords the ability to utilize smokeless tobacco and still maintain the teeth in a clean appearing condition through the use of toothpicks, a mirror or other devices useful to the user of the smokeless tobacco in maintaining a neat, clean appearance.

Cupler U.S. Pat. No. 2,573,311 discloses a receptacle having a plurality of article-containing grooves 18. These article-containing grooves become selectively aligned with an opening in a rotating cover so as to permit needles, or the like, to be dispensed from the article-containing grooves in the receptacle. The rotating cover having the window in it to allow the needles to be dispensed therethrough rotates by pivotation about a central pedestal or post which is inserted in a slot in the center of the base of the receptacle.

Schumacher U.S. Pat. No. 3,024,898 also discloses a container from which needles or other elongated elements can be dispensed at a time when the cover for the receptacle is rotated so as to move a flap to a position such that it does not cover an opening through which the needles move during dispensation.

BRIEF DESCRIPTION OF THE PRESENT INVENTION

The present invention is a container assembly which is versatile in its ability to contain several types of commodities or articles concurrently. For this reason, and because of the nature of the compartments formed within the container assembly, it is especially well suited for including replaceable tins or cans of smokeless tobacco at one side of the assembly, and a plurality of toothpicks disposed in a chamber on the other side of the assembly. A removable, rotatable cover or cap closes the toothpick chamber and carries an outwardly facing mirror. Thus, the toothpicks and the mirror can be used for cosmetic purposes in improving the appearance of the teeth of the smokeless tobacco user. In addition, the chamber or storage compartment formed within a base portion of the assembly, referred to as the cylindrical base and dispenser subassembly, is formed so that articles other than toothpicks can be located therein quite easily.

The chamber for the toothpicks is formed by a pair of parallel, chordal partitions or walls which extend across the cylindrical base and dispenser unit to define an open ended dispensing chamber in which the toothpicks can be located. The open ended dispensing chamber is closed by the rotating cap hereinbefore described. Two small semi-cylindrical chambers are formed on opposite sides of the toothpick chamber or space and can be used to contain various articles, such as dental floss or the like.

An important object of the present invention is to provide a smokeless tobacco dispensing system which includes toothpicks and a mirror, which toothpicks and mirror facilitate and render more pleasant the use of the smokeless tobacco.

Another object of the invention is to provide a container assembly which is highly versatile in the articles or goods which can be stored and carried therein, yet can be quickly dispensed therefrom where a need to do so is encountered.

Additional objects and advantages will become apparent as the following detailed description of the invention is read in conjunction with the accompanying drawings which illustrate a preferred embodiment of the invention.

GENERAL DESCRIPTION OF THE DRAWINGS

DETAILED DESCRIPTION OF A PREFERRED EMBODIMENT OF THE INVENTION

Figure 1:
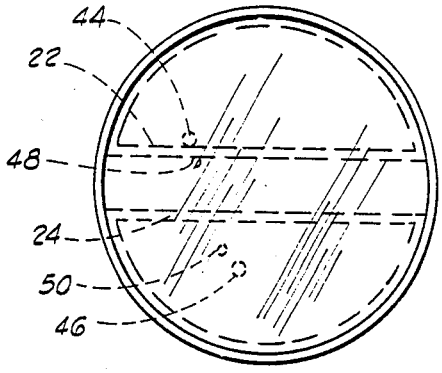
FIG. 1 illustrates the container assembly of the invention as it appears when viewed from the bottom, and is a bottom plan view of the assembly.

The container assembly of the invention includes a cylindrical primary container 10 which has an annular friction-engaging cap 12 which can be manually removed to facilitate access to the contents of the primary container. In one form of the invention and one mode of usage, the primary container 10 can be a metal cylindrical container or can of the type used for containing smokeless tobacco. Other commodities can, however, be contained in the primary container 10, and the size of that container, and its dimensional relationship to the cap 12 can be varied. Other materials of construction, such as plastic, can also be used, rather than metal.

It will also be appreciated that the primary container 10 can be formed as an integral part of the second major portion of the container assembly, i.e. the cylindrical base and dispenser subassembly hereinafter described, rather than being a separate, detachable structure.

The container assembly of the invention further includes a cylindrical base and dispenser subassembly 14. The cylindrical base and dispenser subassembly 14 is dimensioned to frictionally receive the bottom portion of the primary container 10 so that the two principal elements of the container assembly of the invention are interfitted in the manner illustrated in FIGS. 2, 3 and 4. Since one of the principle uses of the present invention is to facilitate the joinder or interfitting of certain dental care adjuncts to be employed by a user of smokeless tobacco, the cylindrical base and dispenser subassembly 14 is preferably dimensioned to receive the most frequently marketed and somewhat standard size of smokeless tobacco cylindrical metallic container 10 or can which is currently marketed.

The cylindrical base and dispenser subassembly 14 includes an upwardly extending, peripheral cylindrical or annular first flange 16. The flange 16 is dimensioned to have a slightly larger diameter than the diameter of the primary container 10 and to fit snugly thereabout. Frictional retention of the primary container 10 in the base subassembly 14 is aided by spaced, small bumps or protuberances 17 carried on the upwardly extending annular flange 16. In the form of the invention where the primary container is formed integrally with the base and dispenser subassembly, the cylindrical flange 16 actually forms the cylindrical side wall of the primary container and receives the cap 12.

The cylindrical base and dispenser subassembly 14 further includes a downwardly extending peripheral cylindrical or annular second flange 18 which is coaxially aligned with the flange 16. These flanges may best be perceived in FIG. 4 of the drawings.

Figure 3:
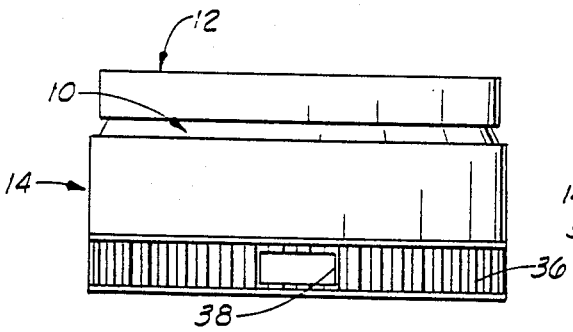
FIG. 3 is a side elevation view of the container assembly of the invention.
Figure 4:
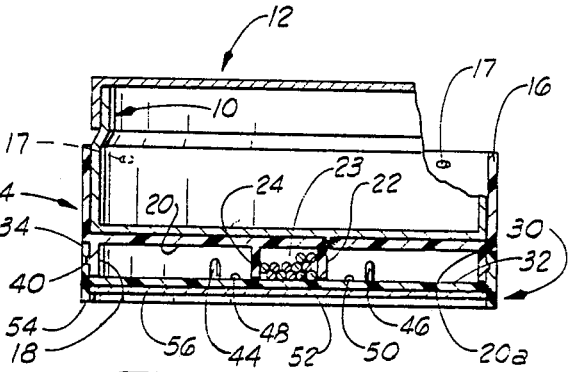
FIG. 4 is a vertical sectional view taken in a vertical plane extending through the center of the container assembly.

A transverse, monoplanar partition or divider plate 20 is positioned between the upwardly extending first flange 16 and the downwardly extending second flange 18 and is joined to these flanges at a circular outer peripheral edge 20*a*. The transverse partition, together with the upwardly extending peripheral flange 16 and the downwardly extending peripheral flange 18 define a pair of opposed or opposite open sided cylindrical chambers. In a preferred embodiment of the invention, the lower portion of the primary container 10 is frictionally received into the upper one of these chambers as previously explained, and as is shown in FIGS. 3 and 4. In the alternate embodiment in which the primary container is integrally formed, the transverse partition constitutes the base or bottom of the primary container.

A pair of parallel chordal partitions 22 and 24 are secured to the downwardly facing side of the transverse partition or divider plate 20 and project normal thereto. In a preferred embodiment of the invention, the chordal partitions 22 and 24 are disposed equidistantly on opposite sides of the center of the transverse partition 20. It is also preferred that the downwardly extending peripheral flange 18 be segmented or interrupted so as to provide open ends to the channel or chordal chamber which is defined by the space 23 between the chordal partitions 22 and 24. Thus, the opposite ends of this space 23 are open due to the interruption or termination of the downwardly extending, peripheral cylindrical second flange 18 to provide a pair of gaps or spaces 26 and 28 at this location.

The cylindrical base and dispenser assembly 14 further includes a dispenser closure cap 30 which is rotatably mounted on the lower side of the base and dispenser assembly. The dispenser closure cap 30 includes a flat, disc-shaped end plate 32 which extends transversely and parallel to the transverse divider plate 20. The plate 32 covers the article storage compartment or chordal chamber defined by the space 23 as shown in FIG. 4. The annular peripheral outer flange 34 forming a part of the dispenser closure cap 30 is provided with a series of alternating, axially extending grooves and ribs which provide knurling 36 on the outer surface thereof, as shown in FIG. 3. The annular peripheral outer flange 34 also is characterized in defining at least one dispensing opening or window 38 therethrough which is depicted in FIG. 3 of the drawings as rectangular in configuration. Other shapes of dispensing openings can be used, however.

It will be noted in viewing FIGS. 3 and 4 that the opening 38 in the annular peripheral outer flange 34 is shown as aligned with the open end of the space 23 forming the chordal chamber or article storage compartment. The dispenser closure cap 30 is rotatably mounted on the downwardly extending peripheral second flange 18 by the frictional, concentric engagement with this flange of the annular peripheral outer cap flange 34 forming a part of the dispenser closure cap. In a preferred embodiment of the invention, the annular peripheral outer flange 34 also defines an annular groove 40 which engages a peripheral rib 41 formed in the outer surface of the downwardly extending peripheral flange 18 and extending over a major portion of the periphery thereof.

For the purpose of controlling the rotation of the dispenser closure cap 30, a pair of arresting studs 44 and 46 project inwardly from the inner surface of the flat, disc-shaped end plate 32, and these arresting studs function to limit the distance which the dispenser closure cap 30 is permitted to rotate upon the downwardly extending peripheral flange 18. Movement is limited by contact of one or the other of the arresting studs 44 and 46 with a surface of one of the chordal partitions 22 or 24.

In addition to the arresting studs 44 and 46, a pair of indexing beads or bumps 48 and 50 are provided on the upwardly facing inner side or surface of the flat, disc-shaped end plate 32 of the dispenser closure cap 30. Each of the indexing beads 48 and 50 is substantially hemispherical in configuration so that it can cam up over the free edge of the respective chordal partition 22 or 24. Thus, by means of these indexing beads, the dispenser closure cap 30 is prevented from undergoing inadvertent or unintended rotation upon the downwardly extending peripheral flange 18 to thereby cause the opening or window 38 to be aligned with one of the gaps 26 or 28 at the ends of the space 23. Such alignment, if not prevented, would permit the objects or articles stored in this space 23 to be dispensed in an untimely and undesirable fashion.

A number of different types of articles or objects can be stored in the chamber defined by the space 23. In a preferred embodiment of the invention, however, elongated toothpicks 52 are placed in this chamber defined between the chordal partitions 22 and 24. The toothpicks 52 are provided for the user of the smokeless tobacco carried in the container 10. If desired, at least one of the toothpicks can have a small brush carried on one end, and a point on the other end to facilitate cleaning of the teeth.

Figure 2:
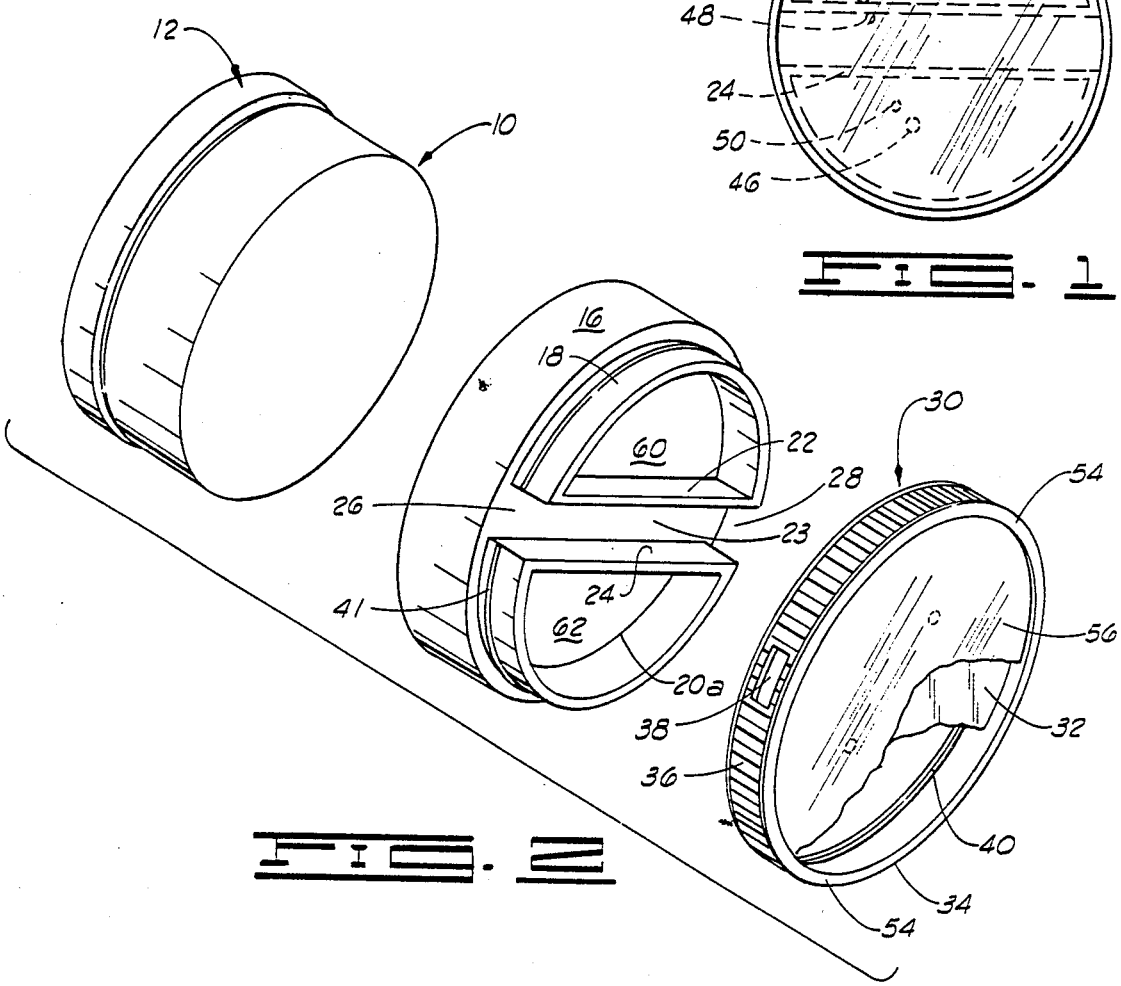
FIG. 2 is an exploded view illustrating the container assembly of the invention. The dispenser closure cap utilized on the bottom of the container assembly is shown removed from the container assembly.

As can best be perceived by reference to FIG. 4, the annular peripheral outer cap flange 34 projects or extends slightly past the plane of the flat disc-shaped end plate 32 in a downward or outwardly projecting direction so as to provide an annular rib or lip 54 at this location. The annular rib or lip 54 then provides a bounding and confining structure for an inset, disc-shaped mirror 56 as illustrated in FIGS. 2 and 4.

OPERATION

In the utilization and operation of the container assembly of the invention, a smokeless tobacco can constituting the primary container 10 is placed into the cylindrical base and dispenser assembly 14 and retained there until all of the tobacco in the can is depleted. The cylindrical container is then removed and is replaced by a new full can of tobacco. The container 10 is dimensioned to afford a relatively tight frictional fit within the upwardly extending peripheral flange 16 of the cylindrical base and dispenser assembly. Such frictional retention is aided by the small bumps or protuberances 17 carried on the inner side of the upwardly extending peripheral flange 16 as illustrated in FIG. 4.

Smokeless tobacco users frequently have the problem of lodging of unsightly tobacco particles between the teeth, and staining of the teeth. It is therefore desirable to have adjuncts to the smokeless tobacco container which facilitate cleaning of the teeth, and viewing the teeth to determine when they have become stained, or the location at which lodged particles of tobacco are located, and therefore to facilitate such cleaning.

In order to allow particles of tobacco to be removed from the teeth, a plurality of toothpicks 52 can be stored in the channel or space 23 between the chordal partitions 22 and 24. A small brush with an elongated handle can also be placed at this location. At a time when the dispenser closure cap 30 is rotated to a location where the dispensing opening or window 38 is aligned with the open end of the space 23, the toothpicks and brush can be dispensed through the opening. As has been previously pointed out, inadvertent rotation of the dispenser closure cap 30 so as to unintentionally align the dispensing opening or window 38 with the open end of the space 23 is prevented by the frictional resistance to the rotation of the dispenser closure cap offered by the indexing beads 48 and 50.

After a toothpick has been dispensed from the channel or space 25 through the dispensing opening or window 38, the user of the smokeless tobacco can employ the toothpick for cleaning the teeth. In doing this, he is aided by the mirror 56 which is disposed in a recessed location within the annular rim or rib 54 which is formed by the projecting lower end of the downwardly extending peripheral flange 18 forming a part of the cylindrical base and dispenser assembly 14. It will be noted that the rim or rib 54 prevents the mirror 56 from contacting a hard surface at such time as the container assembly of the invention is rested on a flat surface, such as a table or the like, with the dispenser closure cap 30 facing downwardly.

As the dispenser closure cap 30 is rotated upon the downwardly extending peripheral flange 18, it is guided in this rotation, and retained interlocked with this flange, by the protuberant annular tongue bead 41 which guides in the annular recess or groove 40. When it is desired to remove the dispenser closure cap 30 from engagement with the downwardly extending peripheral flange 18 of the cylindrical base and dispenser assembly, an adequate removal force is applied in a downward direction such that the closure cap tends to move axially away from the transverse monoplanar partition 20. This removal force is sufficient to snap the annular bead 41 out of the groove 40. When the closure cap 30 is removed, as it is shown removed in FIG. 2, the container assembly can then be inverted so as to stand the assembly upon the cap 12 of the cylindrical primary container 10, and the space 23 will then be exposed from above and can be refilled with toothpicks, or other elongated, relatively thin articles.

It should be pointed out that, as shown in FIG. 2, a pair of chambers 60 and 62 are disposed on opposite sides of chordal partitions 22 and 24 and on opposite sides of the storage channel or space 23. These chambers or compartments 60 and 62 can be used to contain dental floss, a house key, nitroglycerin pills or any of a number of widely disparate small articles or objects which the user of the container assembly may wish to have readily present and available at all times.

Although a preferred embodiment of the invention has been herein described in order to illustrate the principles of use and operation of the invention, various changes can be made in the illustrated structure without departure from the basic principles of the invention. All such changes and innovations are therefore deemed to be circumscribed by the spirit and scope of the present invention, except as the same may be necessarily limited by the appended claims or reasonable equivalents thereof.

What is claimed is:

1. A container assembly comprising:

a cylindrical primary container having an open top;

a closure cap removably retained on the primary container for closing the open top thereof;

a cylindrical base and dispenser subassembly for removably engaging said cylindrical primary container, and for selectively dispensing elongated articles, said cylindrical base and dispenser subassembly comprising;

an annular peripheral first flange dimensioned to receive and extend around said cylindrical primary container;

an annular peripheral second flange coaxially aligned with said annular peripheral first flange;

a transverse divider plate partition disposed between said first and second annular peripheral flanges and having a circular outer peripheral edge portion joined to said first and second annular peripheral flanges, said transverse divider plate partition extending normal to the axis of said primary container; and a pair of substantially parallel chordal partitions secured to, and extending normal to, said transverse divider plate partition and located within said second annular peripheral flange, said chordal partitions defining therebetween an article-containing space within which elongated objects can be contained, said second annular peripheral flange having a gap therein aligned and communicating with the space between said chordal partitions; and a second closure cap rotatably and removably mounted on said annular peripheral second flange for rotation therearound, said second closure cap including:

an outer flange frictionally engaging said second flange, said outer flange defining a dispensing window positioned for alignment with said gap in said second flange, and with said space positioned between said chordal partitions, as said second cap is rotated; and an outer bottom plate extending substantially parallel to said transverse divider plate partition and having a circular outer periphery secured to said outer flange, said outer bottom plate extending across, and in close proximity to, said chordal partitions to cooperate with said chordal partitions in defining said article-containing space and closing one side thereof.

2. A container assembly as defined in claim 1 and further characterized as including:

an arcuate groove formed in and extending around at least a portion of said outer flange or a portion of said annular peripheral second flange; and a protuberance projecting radially from said annular peripheral second flange or said outer flange into said arcuate groove to form indexing and guiding means with said groove for facilitating the guided and retained rotation of said outer flange relative to said second flange.

3. A container assembly as defined in claim 2 wherein said outer bottom plate includes an outwardly facing outer surface and an inner surface facing toward said transverse divider plate, said container assembly further comprising:

a pair of spaced studs secured to and projecting from said inner surface toward said transverse divider plate and forming stops cooperating with said chordal partitions to limit the extent of rotative movement of said second closure cap on said annular peripheral second flange.

4. A container assembly as defined in claim 3 and further characterized as including a pair of indexing beads secured to the inner surface of said bottom plate and frictionally cooperating with said chordal partitions to resist inadvertent rotation of said second closure cap to a position of said annular peripheral second flange at which said dispensing window is aligned with said article-containing space.

5. A container assembly as defined in claim 1 wherein said outer bottom plate includes an outwardly facing outer surface and an inner surface facing toward said transverse divider plate, said container assembly further comprising:

a pair of spaced studs secured to and projecting from said inner surface toward said transverse divider plate and forming stops cooperating with said chordal partitions to limit the extent of rotative movement of said second closure cap on said annular peripheral second flange.

6. A container assembly as defined in claim 1 and further characterized to include a second gap in said annular peripheral second flange at a location 180° around said annular peripheral second flange from said first gap and thus positioned for alignment with said space between said chordal partitions at a time when said first gap is aligned with said space between said chordal partitions.

7. A container assembly as defined in claim 1 and further characterized as including a plurality of circumferentially spaced radially inwardly projecting bumps carried on the radially inner side of said annular peripheral first flange contacting and frictionally retaining said primary container in said cylindrical base and dispenser subassembly.

8. A container assembly as defined in claim 1 and further characterized as including:

a mirror mounted on the outer surface of said outer bottom plate.

9. A container assembly as defined in claim 8 wherein said outer flange of said second closure cap surrounds said mirror.

10. A container assembly as defined in claim 1 wherein said outer bottom plate includes an outwardly facing outer surface and an inner surface facing toward said transverse divider plate, said container assembly further comprising:

a pair of spaced studs secured to and projecting from said inner surface toward said transvere divider plate and forming stops cooperating with said chordal partitions to limit the extent of rotative movement of said second closure cap on said annular peripheral second flange.

11. A container assembly as defined in claim 10 and further characterized as including a pair of indexing beads secured to the inner surface of said bottom plate and frictionally cooperating with said chordal partitions to resist inadvertent rotation of said second closure cap to a position of said annular peripheral second flange at which said dispensing window is aligned with said article-containing space.

12. A container assembly comprising:

an open-topped cylindrical container having an open top for containing a first material, said container including a transverse divider plate bottom of disc-shaped configuration and including a circular outer periphery, said transverse divider plate extending substantially parallel to said open top;

a closure cap removably retained on said container, and extending substantially parallel to said transverse divider plate bottom;

a cylindrical base and dispenser assembly including:

an annular peripheral flange extending around and secured to said divider plate and extending away from, and in coaxial alignment with, said cylindrical container; and a pair of substantially parallel chordal partitions secured to, and extending normal to, said transverse divider plate bottom and located within said annular peripheral flange, said chordal partitions defining therebetween an article-containing space within which elongated objects can be contained, said annular peripheral flange having a gap therein aligned and communicating with the space between said chordal partitions; and a second closure cap rotatably and removably mounted on said annular peripheral flange for rotation therearound, said second closure cap including:

an outer flange frictionally engaging said annular peripheral flange, said outer flange defining a dispensing window positioned for alignment with said gap in said annular peripheral flange, and with said space positioned between said chordal partitions, as said second cap is rotated; and an outer bottom plate extending substantially parallel to said transverse divider plate and having a circular outer periphery secured to said outer flange, said outer bottom plate extending across, and in close proximity to, said chordal partitions to cooperate with said chordal partitions and defining said article-containing space enclosing one side thereof.

13. A container assembly as defined in claim 12 wherein said outer bottom plate includes an outwardly facing outer surface and an inner surface facing toward said transverse divider plate, said container assembly further comprising:

a pair of spaced studs secured to and projecting from said inner surface toward said transverse divider plate and forming stops cooperating with said chordal partitions to limit the extent of rotative movement of said second closure cap on said annular peripheral second flange.

* * * * *